United States Patent [19]

Fraser, III et al.

[11] Patent Number: 4,657,078

[45] Date of Patent: Apr. 14, 1987

[54] METHOD AND DEVICE FOR TESTING A WELL BORE PACKER

[75] Inventors: James M. Fraser, III, Woodlands; M. P. Coronado, Huntsville, both of Tex.

[73] Assignee: Hughes Tool Company, Houston, Tex.

[21] Appl. No.: 814,710

[22] Filed: Dec. 30, 1985

[51] Int. Cl.[4] ..... E21B 23/00

[52] U.S. Cl. ..... 166/123; 166/125; 166/250; 166/387

[58] Field of Search ..... 166/123, 125, 250, 182, 166/387

[56] References Cited

U.S. PATENT DOCUMENTS

| | | | |
|---|---|---|---|
| 3,826,307 | 7/1974 | Brown et al. | 166/120 |
| 4,019,379 | 4/1977 | Thuse | 166/123 |
| 4,019,580 | 4/1977 | Garrett | 166/120 X |

*Primary Examiner*—Stephen J. Novosad
*Assistant Examiner*—Thomas J. Odar
*Attorney, Agent, or Firm*—Charles D. Gunter, Jr.

[57] ABSTRACT

A device and method are shown for testing a packer in a well bore where the packer has an internal bore for conducting fluids and external gripping and sealing means for gripping and sealing the surrounding well bore. The packer is first set at a desired depth within the well bore. The test tool is then made up on a tubing string and has an external collet for engaging a recess provided within the interior bore of the packer. An external shear sleeve on the test tool is initially positioned to underlie the collet fingers when the collet fingers are received within the packer recess to retain the packer on the test tool. A fluid port communicates the test tool internal bore with a pressure responsive area of the shear sleeve for shearing the sleeve and releasing the collet fingers. The packer is then tested by applying pressurized fluid to the well annulus above the set packer. By shearing off the shear sleeve, the test tool can be retrieved to the well surface, leaving the set packer in the well bore.

4 Claims, 8 Drawing Figures

METHOD AND DEVICE FOR TESTING A WELL BORE PACKER

BACKGROUND OF THE INVENTION

1. Field of the Invention

This invention relates to a test tool for testing the sealing integrity of a well bore packer which can be used to retrieve the packer in a single run in the event of an unsuccessful test.

2. Description of the Prior Art

Well packers are known for selectively sealing and/or anchoring a tubing string to a surrounding well conduit or liner. Packers are known which can be set in the sealing/anchoring configuration on a wireline, by manipulation of a tubing string from which the packer is suspended, or by application of hydraulic pressure by means of the tubing string, for example. The packer typically comprises a tubular mandrel having circumferential sealing and gripping elements mounted on the exterior thereof for gripping and sealing engagement with the well bore.

The gripping members are extendible radially into gripping engagement with the well bore in response to relative axial movement of wedging surfaces which cooperate with the gripping elements to engage the well bore. The resilient seal elements are similarly expanded radially into sealing engagement with the well bore in conjunction with axial compression of the sealing members. The sealing and anchoring mechanisms are set in engagement with the surrounding well bore, in response to relative longitudinal movements of various packer components, affected either hydraulically or mechanically.

Once the packer has been set in the well bore, it is desirable to conduct a test of the sealing integrity of the packer to insure that the well annulus above the packer is sealed off from the well annulus below the packer. This can be done, for instance, by sealing the well head and applying pressure to the well annulus above the set packer. An appropriate pressure build- up can be detected at the well head which indicates that the well annulus above the packer is, in fact, sealed off from the well annulus below the packer.

Retrieving tools are also known for well packers which are used to retrieve a packer which has been released from the set condition to the well surface. In the prior art devices, testing and subsequent retrieval of a packer which did not test successfully required more than one run of the appropriate tool to the packer location within the well bore. That is, one run was typically required in conducting the packer test, and another run was required for a retrieval tool to engage and retrieve the unsuccessfully set packer.

The present invention has as its object the provision of a packer test tool which allows a packer to be tested, and in the same run, retrieved to the well surface in the event of an unsuccessful test. In the event of a successful test, the test tool is releasable from the set packer and can be retrieved to the well surface without the necessity of a wireline run.

SUMMARY OF THE INVENTION

The test tool of the invention is used to test a packer of the type having an interior bore for conducting fluids and external gripping and sealing means for gripping and sealing against the surrounding well bore. The test tool includes a generally cylindrical tubular member having an exterior and an internal bore with a connecting end adapted to be made up in a well tubing string.

The test tool has a collet with a collet base and downwardly extending collet fingers carried on the exterior thereof. The collet fingers are adapted to be received within a recess formed in the interior bore of the packer for engaging the packer on the test tool. The test tool has an external shear sleeve which is initially positioned to underlie the collet fingers when the collet fingers are received within the packer recess to thereby retain the packer on the test tool. Port means in the test tool are provided communicating fluid pressure from the interior of the test tool to a pressure responsive piston area of the shear sleeve for shearing the sleeve and releasing the collet fingers, whereby the test tool can be released from the set packer and retrieved to the well surface in the case of a successful packer test.

In the method of the invention, the packer is first set at a desired depth within the well bore. The test tool is then made up on a tubing string and run into the interior bore of the packer to engage the packer on the test tool. The packer is then tested by supplying pressurized fluid on at least one side of the packer external sealing means. In the event of a successful packer test, the internal bore of the test tool is pressurized to disengage the test tool and the test tool is retrieved to the well surface by raising the tubing string, leaving the packer in the well bore. In the event of an unsuccessful packer test, the collet fingers remain engaged within the recess formed in the interior bore of the packer and the packer can be retrieved to the well surface by raising the packer and the test tool from the well bore on the tubing string.

Additional objects, features and advantages will be apparent in the written description which follows.

DETAILED DESCRIPTION OF THE INVENTION

Figure 1A:
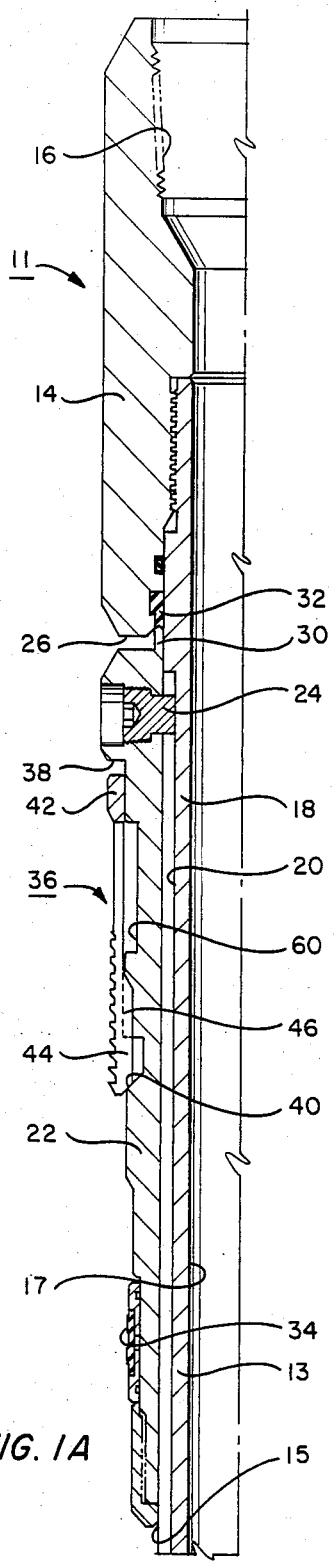
FIG. 1A is a side, cross-sectional view of the upper portion of the test tool of the invention before being made up in a string of pipe for running into the well bore.
Figure 1B:
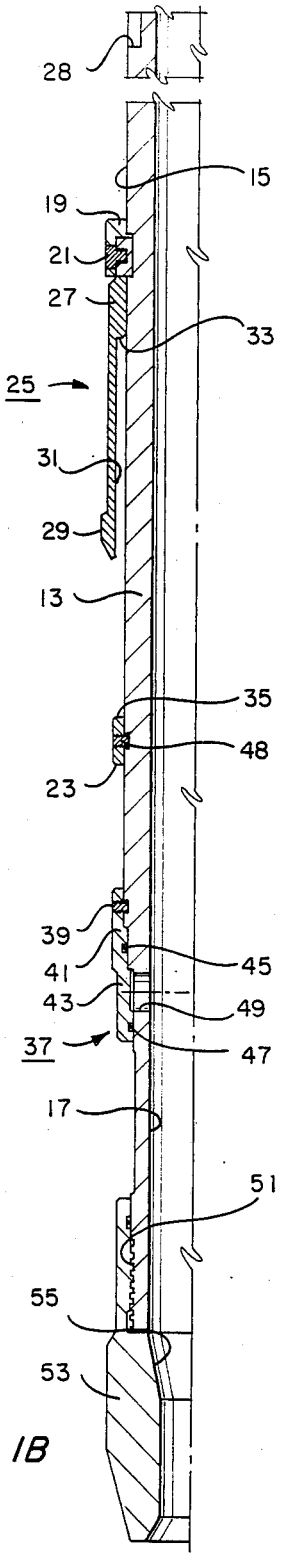
FIG. 1B is a downward continuation of the test tool of FIG. 1A showing the lower portion thereof.

FIGS. 1A and 1B show the test tool of the invention, designated generally as 11. The test tool 11 includes a cylindrical tubular member 13 having an exterior 15 and an internal bore 17. The tubular member 13 continues upwardly and terminates in a box connection 14, which is oppositely arranged to a lower box end 53. The box connection has an internally threaded extent 16 for connection in a tubing string for running the test tool into the well bore.

The upper extent 18 of the tubular member 13 is provided with a pair of elongate slots (slot 20 shown in FIG. 1A) located equidistantly about the circumference of the tubular member. A tubular, sliding latch 22 has a pair of transverse pins (pin 24 shown in FIG. 1A) which allow the latch 22 to slide along the longitudinal axis of the tubular member between an abutment 26 and the lower slot end 28. The sliding latch 22 has an upwardly extending lip 30 which engages a seal ring 32 on the underside of abutment 26 when the latch 22 is in the position shown. The latch 22 also has an external seal region 34 for sealing within the bore of the packer, as will be discussed.

A latch collet 16 is carried about the latch 22 between an upper abutment 38 and a lower shoulder 40 formed on the exterior of the latch 22. The collet 36 has a ring-shaped collet body 42 and a plurality of downwardly extending, externally threaded collet fingers 44. Collet fingers 44 are received within a recess 60 formed on the exterior of the latch 22. A plurality of cogs 46 are formed in the exterior surface of the latch 22. Each cog 46 is adapted to be received within a slot provided between two of the neighboring collet fingers 44, whereby torque transmitted through the tubular member 13, pins 24 and latch 22 is transmitted to the collet 36.

If the reader desires, further details of the construction and operation of the latch 22 and latch collet 36 can be obtained from U.S. Pat. No. 4,513,822, issued Apr. 30, 1985, and assigned to the assignee of the present invention, the disclosure of which is hereby incorporated by reference.

As shown in FIG. 1B, the tubular member 13 has an upper circumferential ring or stop 19 mounted on the exterior 15, as by screws 21 and a lower stop 23 which is spaced-apart from the upper stop 19 on the exterior 15. Stop 23 is preferably connected to the tubular member 13 by one or more shear screws 48. A collet 25 is slidably received between the upper and lower stops 19, 23 on the exterior 15. The collet 25 includes a circumferential collet base 27 and a plurality of downwardly extending legs which terminate in collet fingers 29. The collet fingers 29 can be flexed radially inwardly in the direction of the exterior 15, from the position shown in FIG. 1B.

The undersides 31 of the collet legs are spaced apart from the exterior 15, which allows the fingers 29 to ride over the lower stop 23, until the internal shoulder 33 of the collet base contacts the external shoulder 35 of the lower stop 23.

The test tool 11 also includes a shear sleeve 37 mounted on the exterior 15 by means of one or more shear screws 39. The shear sleeve 37 includes an upper region 41 of greater relative external diameter and a stepped, lower region 43 of lesser relative external diameter. When the collet internal shoulder 33 is in contact with the external shoulder 35 of the lower stop 23, the collet fingers 29 overlie the upper region 41 of shear sleeve 37 (see FIGS. 2B and 4).

The shear sleeve 37 includes internal O-rings 45, 47 which, in the position shown in FIG. 1B, isolate a fluid port 49 which communicates the internal bore 17 of the test tool 11 with the exterior thereof. The region of the shear sleeve 37 between the O-ring seals 45, 47 constitutes a pressure responsive piston area of the shear sleeve for shearing the sleeve once a predetermined pressure increase is achieved within the internal bore 17.

The lowermost extent of the tubular mandrel 13 is provided with external threads 51 for engaging internally threaded box member 53. The box member 53 also includes a region of decreased internal diameter 55 which serves as a ball seat for receiving a ball dropped through the tubing string from the well surface and through the internal bore 17 to close off the lowermost end of the test tube 11 and allow pressurization of the bore 17.

Figure 2A:
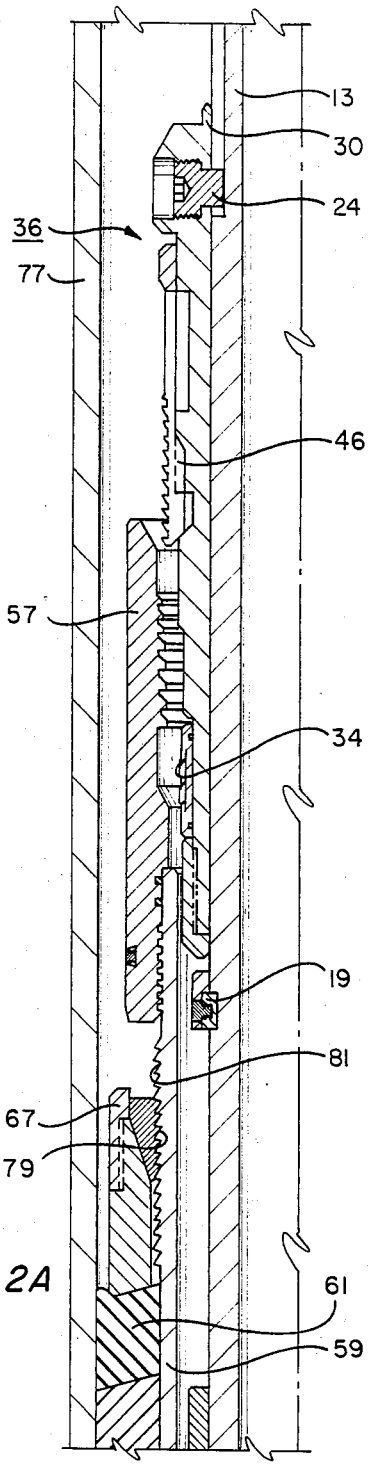
FIG. 2A is a partial, cross-sectional view of the upper end of a set packer in a well bore with the test tool of the invention being run into position within the bore of the packer.
Figure 2B:
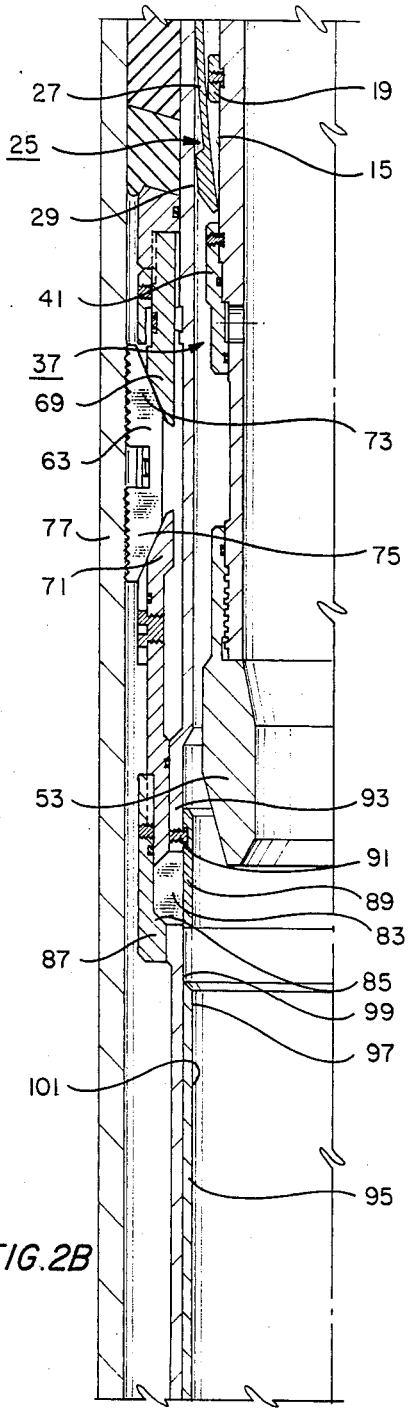
FIG. 2B is a partial, cross-sectional view of the lower end of the set packer and test tool of FIG. 2A.

The test tool 11 of the invention is used for testing the seal of a packer in a well bore. A suitable packer can be commercially obtained from Brown Oil Tools in Huntsville, Tex., as the "RR-2" packer. The operative details of such a packer are shown in FIGS. 2A and 2B. The packer includes an upper connecting end 57 having an internally threaded surface 58 and a downwardly extending mandrel 59, on which is mounted external sealing means 61 and external gripping means 63. The threaded surface 58 is preferably comprised of left hand threads which are adapted to be engaged by mating threads of the collet fingers 44 so that the latch 36 can be released by right hand rotation of the tubing string.

The packer is lowered into the well bore and set by means of a wire line setting tool having a sleeve (not shown) which can be driven axially downwardly to move the wedge member 67 in the direction of the annular resilient seals 61 to compress the seal members. Axial movement of the wedge member 67 also causes the cones 69, 71 to move beneath upper and lower gripping slips 73, 75, causing the slips to grip the surrounding well casing. Once the slips 73, 75 have gripped the casing 77, the seal members 61 are compressed and move radially outwardly to seal against the surrounding casing. Wicker teeth 79 on the wedge member 67 and oppositely arranged teeth 81 on the mandrel 59 prevent opposite relative movement and relaxation of the seal means 61 and gripping means 63. The steps involved in setting the well packer are conventional and do not form a part of the rest method of the invention.

In the "set" position of the packer shown in FIG. 2B, the lower cone 71 is retained in the position shown by means of a plurality of radially movable dogs 83 which rest on a shoulder 85 formed by the interior of packer end element 87. An internal shear ring 89 is initially fixed to themandrel lower end 93 by means of one or more shear screws 91 and retains the dogs 83 against shoulder 85. An inner tubular member 95 is located within the downward continuation of mandrel 59 and terminates at a point 97 spaced apart from the shear ring 89 to create an annular recess or groove 99 within the internal bore 101 of the packer.

The method of testing a packer in a well bore will now be described. FIGS. 2A and 2B show a packer set at a desired depth within the well bore with the gripping and sealing elements engaging the surrounding well casing 77. The test tool 11 is made up on a tubing string and run into position within the bore of the well packer. In the running-in position, the collet 25 is free to slide upwardly from the position shown in FIG. 2B so that the collet fingers are free of the upper region 41 of the shear sleeve 37 and can thus flex radially inwardly toward the exterior surface 15.

Figure 3A:
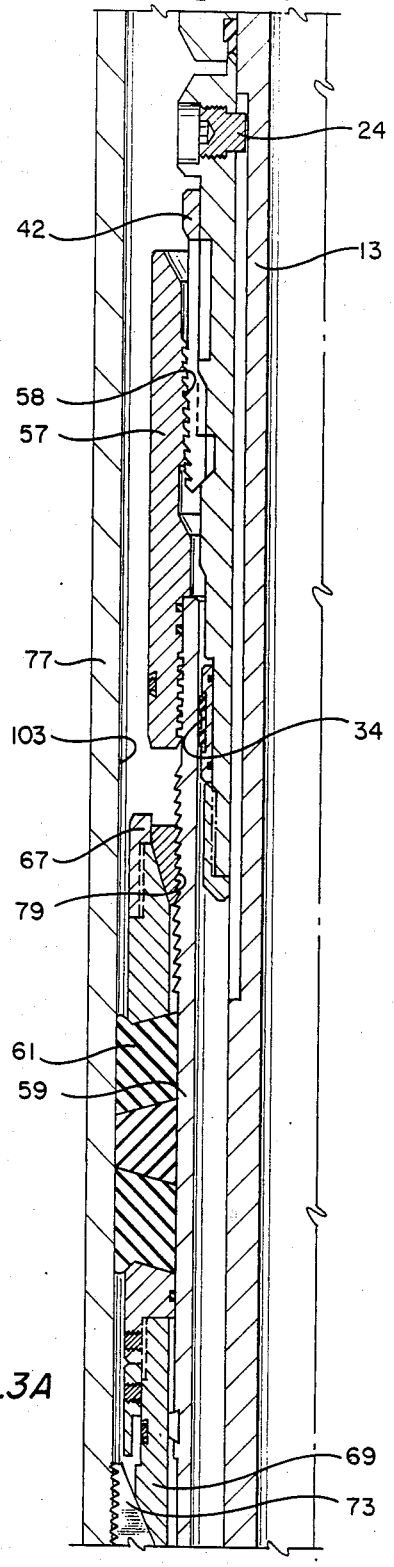
FIG. 3A is a partial, cross-sectional view of the well packer of FIG. 2A with the test tool engaged within the interior bore of the set packer.
Figure 3B:
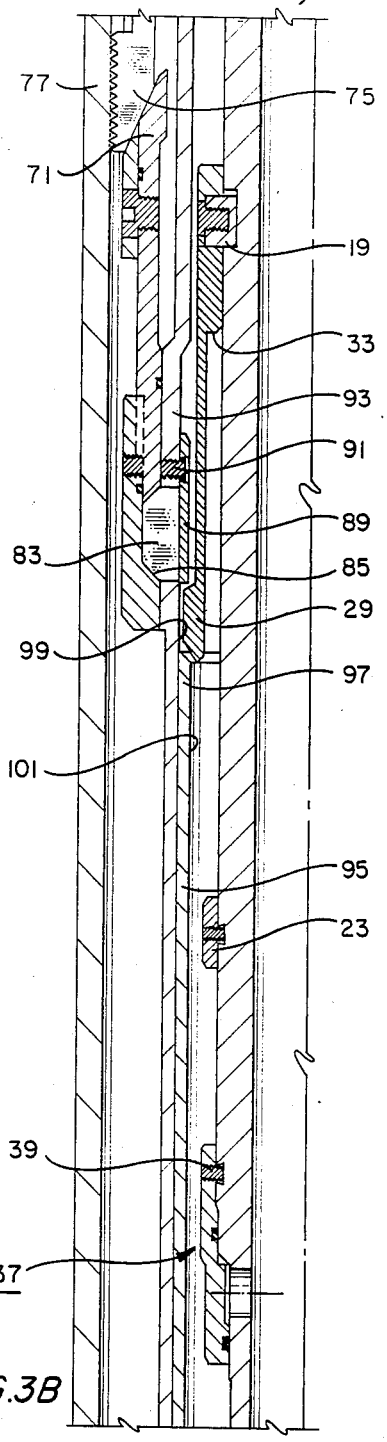
FIG. 3B is a downward continuation of the test packer and test tool of FIG. 3A.
Figure 4:
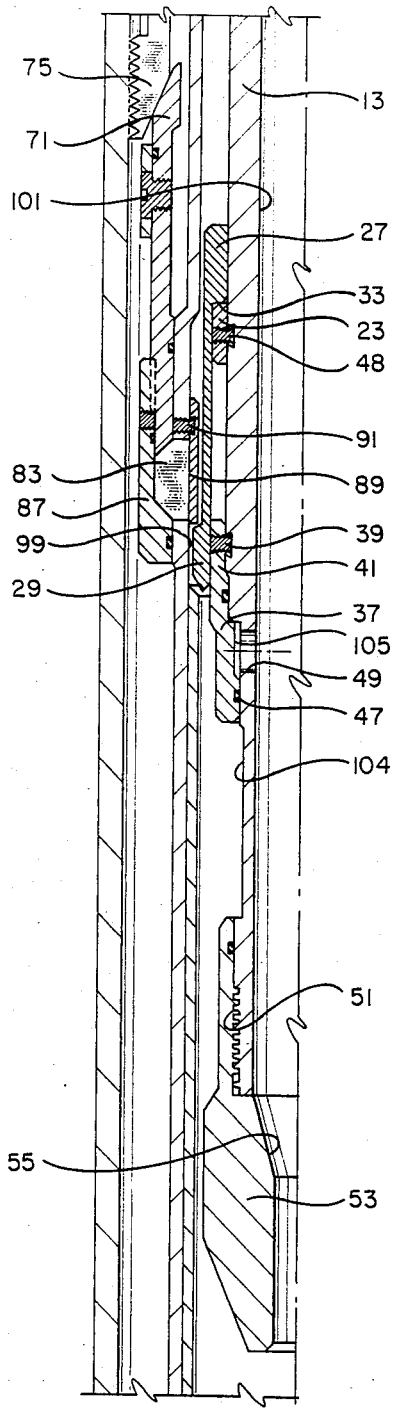
FIG. 4 is a view of the lower end of the set packer and test tool of FIG. 3B showing the shear sleeve in position beneath the collet fingers of the test tool and with the collet fingers engaging the recess of the packer.

The tubing string is lowered until the collet fingers 29 are able to flex radially outwardly to engage the recess 99 provided in the interior bore of the anchored well packer, as shown in FIG. 3B. Once the collet fingers 29 have engaged the recess 99, the tubing string is lifted until the lower stop 23 engages the internal shoulder 33 of the collet base (FIG. 4). At this point, the upper region 41 of the shear sleeve 37 underlies the collet fingers 29, thereby retaining the collet fingers within the recess 99.

Figure 5:
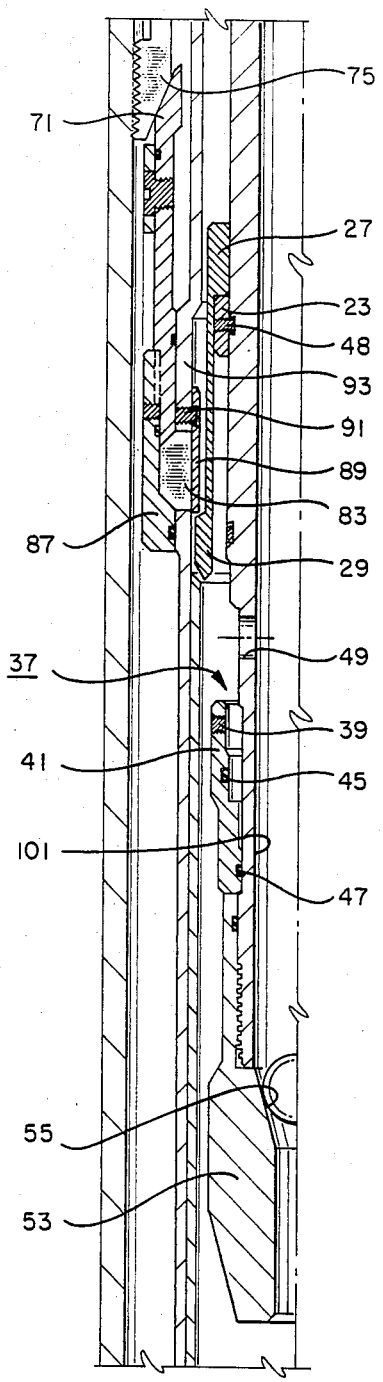
FIG. 5 is a view similar to FIG. 4 but showing the shear sleeve released from beneath the collet fingers to allow retrieval of the test tool to the well surface.

The integrity of the seal means 61 of the packer can be tested by first setting down weight on the tubing string to engage the lip 30 of the latch 36 with the seal ring 32 (FIG. 1A). The external seal region 34 and seal 32 now seal off the test tool within the bore of the packer. The well head can now be closed off and fluid pressure can be applied to the annular space (103 in FIG. 3A) between the tubing string and the casing 77. If the packer test is successful, a ball is dropped to land in the ball seat (55 in FIG. 1) of the test tool 11 and fluid pressure is applied to the internal bore 101 of the test tool. Since the ball seat 55 is located below the port 49 in the test tool 11, the fluid pressure acts upon the pressure responsive seal element (105 in FIG. 4). A predetermined pressure increase within the internal bore 101 of the test tool 11 causes the shear screws 39 to shear, thereby allowing the shear sleeve 37 to move from the position shown in FIG. 4 to the release position shown in FIG. 5. The retrieving tool can then be released from the packer with right hand rotation causing collet 36 to disengage from the internally threaded surface 58 of the packer upper connecting end 57. Because the upper region 41 of the shear sleeve 37 no longer underlies the collet fingers 29, the test tool 11 can be retrieved to the well surface, leaving the set packer in the well bore.

In the event of an unsuccessful packer test, the packer can be retrieved to the well surface on the test tool 11 by pulling upwardly on the tubing string from the position shown in FIG. 4. The latch 22 first slides in the slots 20 (see FIGS. 1A and 1B) which allows the weight of the tubing sting to be picked up before the resistance of the packer is felt. Because the shear sleeve 37 is in place beneath the collet fingers 29 (see FIG. 4), the collet fingers cannot flex radially inwardly. Once the lower stop 23 reaches the internal shoulder 33 of the collet 25, upward force on the tubing string acts upon the shear ring 89, shearing screws 91 and shifting it upwardly from beneath the dogs 83. Upward axial movement of the shear ring 89 allows the dogs 83 to move radially inwardly, thereby allowing downward axial movement of the cone 71. Downward movement of the cone 71 allows inward radial movement of the slip 75 which, in turn, allows the sealing means 61 to relax. The packer is then pulled from the well bore on the test tool 11 by means of the collet 36 which is engaged with the internally threaded surface 58 of the packer upper connecting end 57.

Because the lower stop 23 is attached by shear pins 48, the stop can be sheared loose upon application of a predetermined tension to the tubing string. This provides a safety release, since the collet fingers 29 could then move radially inwardly into the annular region 104 on the exterior of the tubular member 13 without the necessity of shearing the sleeve 37. The retrieving tool can then be released from the packer with right hand rotation causing collet 36 to disengage and the retrieving tool can be pulled from the well bore.

An invention has been provided with serveral advantages. The test tool of the invention is simple in design and economical to manufacture. The test tool can be run on a tubing string and stabbed into the bore of a set packer for performing a packer test. The packer can either be left in the well bore or retrieved to the well surface without requiring multiple trips of the tubing string into the well bore. This single trip operation results in a savings in operator time and effort.

While the invention has been shown in only one of its forms, it is not thus limited but is susceptible to various changes and modifications without departing from the spirit thereof.

We claim:

1. A method of testing a packer in a well bore, the packer being of the type having an interior bore for conducting fluids and external gripping and sealing means for gripping and sealing against the surrounding well bore, comprising the steps of:

first setting the packer at a desired depth within the well bore;

making up a test tool having an internal bore on a tubing string, the test tool having engagement-means on the exterior thereof for engaging the interior bore of the previously set packer to engage the packer on the test tool;

providing pressure responsive means on the exterior of the test tool which are actuable by pressurizing the internal bore of the test tool to release the engagement means and disengage the packer from the test tool;

thereafter running the test tool on the tubing string into the interior bore of the previously set packer and engaging the packer on the test tool;

testing the packer by supplying pressurized fluid on at least one side of the packer external sealing means; and;

retrieving the packer to the well surface in the event of an unsuccessful test in a single trip of the tubing string and without removing the test tool and tubing string from the interior bore of the packer by raising the packer and test tool from the well bore on the tubing string.

2. A method of testing a packer in a well bore, the packer being of the type having an interior bore for conducting fluids and external gripping and sealing means for gripping and sealing against the surrounding well bore, comprising the steps of:

first setting the packer at a desired depth within the well bore;

thereafter lowering a test tool having a generally cylindrical exterior and an internal bore on a tubing string to engage the interior bore of the previously set packer, the test tool having an external collet carried thereon with collet fingers which are received within a recess formed in the interior bore of the packer for engaging the packer on the test tool;

providing an external shear sleeve on the test tool, the shear sleeve being initially positioned to underlie the collet fingers when the collet fingers are received within the packer recess to thereby retain the packer on the test tool, the test tool also being provided with a port for communicating fluid pressure from the interior of the test tool for shearing the sleeve and releasing the collet fingers;

testing the packer by supplying pressurized fluid on at least one side of the packer external sealing means;

in the event of a successful test, sealing off the internal bore of the test tool at a point below the internal port;

pressurizing the internal bore of the test tool to supply pressure through the port to the pressure responsive seal area of the shear sleeve to shear the sleeve and release the collet fingers; and retrieving the test tool to the well surface by raising the tubing string.

3. The method of claim 2, wherein the packer is tested by applying pressure to the well annulus above the packer in the well bore.

4. A test tool used for testing the seal of a packer in a well bore, the packer being of the type having an interior bore for conducting fluids and external gripping and sealing means for gripping and sealing against the surrounding well bore, the test tool comprising:

a generally cylindrical tubular member having an exterior and an internal bore, and which is adapted to be made up in a well tubing string, the test tool having a collet with a collet base and downwardly extending collet fingers slidably received on the exterior thereof between spaced-apart upper and lower stops, the collet fingers being adapted to be received within a recess formed in the interior bore of the packer for engaging the packer on the test tool;

the test tool having an external shear sleeve which is initially positioned a selected distance from the lower stop on the exterior of the test tool to underlie the collet fingers when the collet fingers are received within the packer recess and when the lower stop contacts the collet base to thereby retain the packer on the test tool and to retrieve the packer and test tool in the event of an unsuccessful test; and port means in the test tool for communicating fluid pressure from the interior of the test tool to a pressure responsive piston area of the shear sleeve for shearing the sleeve and releasing the collet fingers, whereby the test tool can be released from the set packer and retrieved to the well surface in the case of a successful packer test.

* * * * *